US012281419B2

(12) United States Patent
Marchenkov

(10) Patent No.: US 12,281,419 B2
(45) Date of Patent: Apr. 22, 2025

(54) THREE-DIMENSIONAL KNITTED MATERIAL

(71) Applicant: Dmitry Valeryevich Marchenkov, Moscow (RU)

(72) Inventor: Dmitry Valeryevich Marchenkov, Moscow (RU)

( * ) Notice: Subject to any disclaimer, the term of this patent is extended or adjusted under 35 U.S.C. 154(b) by 566 days.

(21) Appl. No.: 17/284,882

(22) PCT Filed: Oct. 17, 2018

(86) PCT No.: PCT/RU2018/000692
§ 371 (c)(1),
(2) Date: Apr. 13, 2021

(87) PCT Pub. No.: WO2020/080968
PCT Pub. Date: Apr. 23, 2020

(65) Prior Publication Data
US 2021/0388545 A1 Dec. 16, 2021

(51) Int. Cl.
*D04B 21/16* (2006.01)

(52) U.S. Cl.
CPC ..... *D04B 21/165* (2013.01)

(58) Field of Classification Search
CPC ..... D04B 21/165
See application file for complete search history.

(56) References Cited

U.S. PATENT DOCUMENTS 951,033 A * 3/1910 Steber ..... D04B 1/10 66/200
3,264,846 A * 8/1966 Pfrommer ..... D04B 1/02 66/196
4,267,710 A * 5/1981 Imamichi ..... D04B 1/12 66/196
4,356,710 A * 11/1982 Mizuno ..... D04B 1/00 66/196
5,373,713 A * 12/1994 Miller ..... D04B 1/24 66/196
5,783,277 A * 7/1998 Rock ..... B32B 5/26 428/95
2012/0279260 A1* 11/2012 Dua ..... A43B 1/04 66/171
2014/0242869 A1* 8/2014 Huang ..... D04B 1/18 442/306
2018/0199668 A1* 7/2018 Yumiba ..... D04B 7/30

FOREIGN PATENT DOCUMENTS

EP 627517 A1 12/1994
EP 756030 B1 1/1997
EP 994207 A1 4/2000

* cited by examiner

*Primary Examiner* — Megan E Lynch
(74) *Attorney, Agent, or Firm* — Craft Chu PLLC; Andrew W. Chu

(57) ABSTRACT

The three-dimensional knitted material includes knitted layers that are connected to one another to form a three-dimensional product. Each wale or course in a layer is formed by using an end of a thread that is a continuation of a loop of the preceding course or wale or layer to create at least two loops of the current course or wale in different planes. The loops of the current course or wale are run through at least one loop of a neighboring wale or course or layer of the knitted material. The structural regularity of a knitted material is increased, making it possible to create three-dimensional products having a complex shape, inter alia, having internal cavities, and increasing the filtration properties of the material.

5 Claims, 7 Drawing Sheets

THREE-DIMENSIONAL KNITTED MATERIAL

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates to the textile industry, specifically to a three-dimensional knitted material, and may be used in various technical fields, in particular for manufacturing three-dimensional filters, geogrids, building structures.

2. Description of Related Art Including Information Disclosed Under 37 CFR 1.97 and 37 CFR 1.98

Structures of three-dimensional knitted materials comprising several layers of knit fabrics connected to each other for forming a three-dimensional product (see, e.g., Patent U.S. Pat. No. 5,783,277, 21.06.1998, European Patent EP 0994207, 19.04.2000) are known in the art.

The closest analog to this invention is a three-dimensional knit fabric described in the application for European Patent EP 0756030, 31.12.1997. The product comprises two knit fabric layers, each having loops formed therein which are oriented in a perpendicular plane and provide connections between said layers.

A disadvantage of the known analogs is the absence of the possibility of producing three-dimensional knit fabric structures of a complex shape, which is associated with the presence of irregular connections between layers.

BRIEF SUMMARY OF THE INVENTION

The object of the proposed invention is to overcome the disadvantages of the known analogs, including the closest analog.

The technical effect of the invention consists in increasing the structural regularity of the knitted material, making it possible to create three-dimensional products of a complex shape, including those having internal cavities, and increasing the filtration properties of products manufactured from the material.

The above technical effect is achieved owing to the fact that the three-dimensional knitted material comprises knitted layers connected to each other for forming a three-dimensional product. Each wale or course in a layer is formed by using an end of a thread that is a continuation of a loop of the preceding course or wale or layer to create at least two loops of the current course or wale in different planes; wherein said loops of the current course or wale are run through at least one loop of a neighboring wale or course or layer of the knitted material.

Moreover, the above technical effect is achieved in particular embodiments of the invention, according to which:

- loops of each current course or wale include a first loop formed in the plane of a knitted layer, and a second loop formed in a plane substantially close to the perpendicular plane of the knitted layer, or, in the reverse order: initially, a first loop is formed in a plane close to the perpendicular one, and then a second loop is formed in the plane of the current knitted layer;
- for the very first or initial layer, a loop is generally run through at least one loop of a neighboring wale or course or layer of a knitted material in the area of its vertex, and a second loop is formed from an end of a thread of the first loop and run through that loop after the first one;
- for a second, third, etc. intermediate layers of the first course, a first loop is generally run through at least one loop of a layer substantially close to the perpendicular, currently formed layer in the area of its vertex, and a second loop is formed from an end of a thread of the first loop and run through that loop after the first one in a direction close to the direction perpendicular to the layer where the first loop is formed, or, in the reverse order: the first loop is formed in the direction close to the perpendicular one, and the second loop is formed in the currently formed layer;
- for a second, third, etc. intermediate layers of the second, third, etc, intermediate courses, a first loop (of a new course, wale) is generally run through at least two loops (hereinafter-"formed loops"), one of them being a loop of a neighboring wale or course or layer in the same plane, and the other being a loop of a neighboring wale or course or layer in a plane substantially close to perpendicular to the plane of the current layer. The first loop is run in the area of the vertices of the formed loops. A second loop (in a new course, wale) is formed from an end of a thread of the first loop and run through the same formed loops after the first loop, or in the reverse order: a direction and order of formation of the first loop are changed accordingly to a direction and order of formation of the second loop (as mentioned above);
- an end of a thread of the second loop in the current course or wale is a continuation for loops of a next course or wale in the current layer, or for loops of a next layer;
- a knitted material is formed from one continuous thread;
- a knitted material is formed from several threads.

Contrary to the known analogs, the proposed knitted material has a principally different pattern of forming loops, according to which at least two loops are formed in different planes from a thread of a loop of the preceding course or wale or layer. Such configuration of loops produces regular connections between knitted layers, which has not been achieved by the analogous solutions. This enables, in its turn, to manufacture three-dimensional products of complex shapes from the knitted material, produce regular layers successively, use various weave types similarly to a classic knitted material, but simultaneously in at least two planes close to perpendicular ones.

BRIEF DESCRIPTION OF THE SEVERAL VIEWS OF THE DRAWINGS

The essence of the invention is explained in the accompanying drawings.

Figure 1:
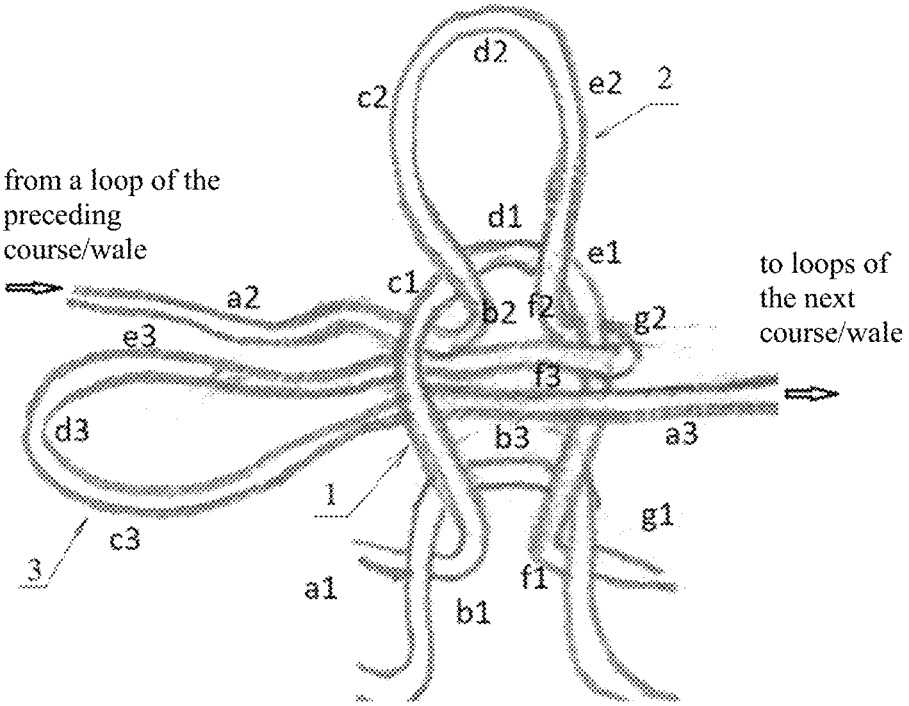
FIG. 1 shows a schematic view of a configuration of loops in one wale or course when they are formed starting from a face loop.

The structural elements and their parameters are designated in the drawings by the following symbols:

1—loop of a neighboring wale, or course, or layer a first next planar loop 1 of the first thread 1'), relative to which two loops in the current course or wale of a knitted material are formed;

2—first loop of the current course or wale second next planar loop 2 of the second thread 2', which is formed in the plane of a knitted layer;

3—second loop of the current course or wale (second next nonplanar loop 3 of the second thread 2', which is formed in a plane perpendicular to the plane of the knitted layer;

a3'1, a3'2, 2', 1'—threads;

100—first layer of a three-dimensional knitted material;

111,111'—loops of the first layer, first wale, first course (first planar loop 111, first nonplanar loop);

112, 112'—loops of the first layer, first wale, second course (second planar loop 112, second nonplanar loop 112");

121,121'—loops of the first layer, second wale, first course (first next planar loop 121, first next nonplanar loop 121');

122, 122'—loops of the first layer, second wale, second course (second next planar loop 122, second next nonplanar loop 122');

200—second layer of the three-dimensional knitted material;

211, 211', 212, 212', 221, 221, 222, 222'-loops of the second layer (third thread

3' for third planar loop 211, third nonplanar loop 211', third next planar loop 221, third next not planar loop 221', fourth thread 4' for fourth planar loop 212, fourth nonplanar loop 212', fourth next planar loop 222, fourth next not planar loop 222');

a, b, c, d, e, f, g—points of knitted loops;

X, Y, Z—space axes showing the relative arrangement of loops and layers of the knitted material.

DETAILED DESCRIPTION OF THE INVENTION

The proposed three-dimensional knitted material has a set of layers (100, 200, etc.), each of them consisting of a plurality of courses or wales. Each new course or wale is produced simultaneously in two planes, in particular in a horizontal plane (X, Y) being the plane of a knitted layer, and in a vertical plane (X, Z) which is perpendicular to that plane.

Loops are formed by means of forming at least two loops (2, 3) from a thread, that is a continuation of a loop of the preceding course or wale or layer, in each current course or wale. This is shown in FIGS. 1, 2 for two weave types: with a face loop (FIG. 1) and with a purl (FIG. 2).

Figure 2:
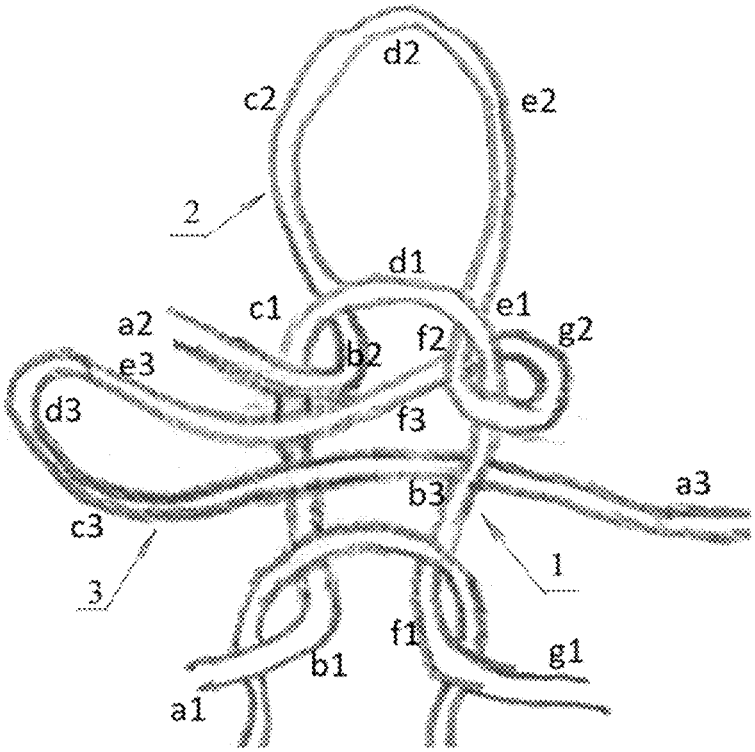
FIG. 2 shows a schematic view of a configuration of loops in one wale or course when they are formed starting from a purl.

Loops are produced as follows:

FIG. 1 shows for illustrative purposes the first course or wale formed by the classic technique. Starting from the second course or wale, a connection is formed not only in a horizontal plane, but also in a vertical plane.

After the initial step and formation of an a1-b1-c1-d1-e1-f1-g1 loop (1) of the neighboring (first) course or wale first next planar loop 1 of the first thread 1', a1-b1-c1-d1-e1-f1-g1 being regions of the first next planar loop 1) by the classic technique, the straight a2-a3 thread in the second (current) course from a loop of the preceding wale or course (if the course is started, the preceding loop will be the loop (1)) is bent into the first loop (2) of the horizontal a2-b2-c2-d2-e2-f2-g2 course (second next planar loop 2 of the second thread 2', a2-b2-c2-d2-e2-f2-g2 being regions of the second next planar loop) and is pulled through the b1-c1-d1-e1-f1 region of the loop (1) so that the b2-c2-d2-e2-f2 region is over the b1-c1-d1-e1-f1 region, and the a2-b2 and f2-g2 regions are over the b1-c1-d1-e1-f1 region.

In this step, the formation of a second loop (3) in the vertical a3-b3-c3-d3-e3-f3-g2 plane is started (second next nonplanar loop 3 of the second thread 2', a3-b3-c3-d3-e3-f3-g3 being regions of the second next nonplanar loop).

Then, the f2-g2 region is bent so as the g2-f3 region can run over the e1-f1 region, and the f3-e3 region can run under the b1-c1 region. After this, the e3-d3-c3 region is bent so as to form a loop and is run through the a1-b1-c1-d1-e1-f1-g1 loop in such a way that the c3-b3 region can run under the b1-c1 region, and the b3-a3 region can run over the f1-e1 region.

This way, the formation of the two loops (2) and (3) (second next planar loop 2, second next nonplanar loop 3) in the current wale is complete, and a new loop may be similarly formed in the next wale of the course. In this case, a3 will be the entry point of the figure similar to the figure having the a2 entry point.

In another embodiment of the invention, the second loop (3) of the current course or wale (as the third, fourth, etc. loops) may be formed from the g2-a3 thread in a horizontal plane by bending the g2-a3 region so that it can run with its f3-e3, b3-c3 regions under the b1-f1 region.

If the b3-a3 is bent so that the b3 point is over the e1-f1 region and the a3 point is under the e1-f1 region, then, similarly to the above-described procedure, a third, fourth, etc. loops may be formed in a horizontal plane from a loop of the preceding course or wale. As for the third loop, it is located similarly to the a3-f3 regions of the second loop (3).

All the above steps relating to an outer (face) loop may be carried out similarly for a purl also (FIG. 2).

Figure 3:
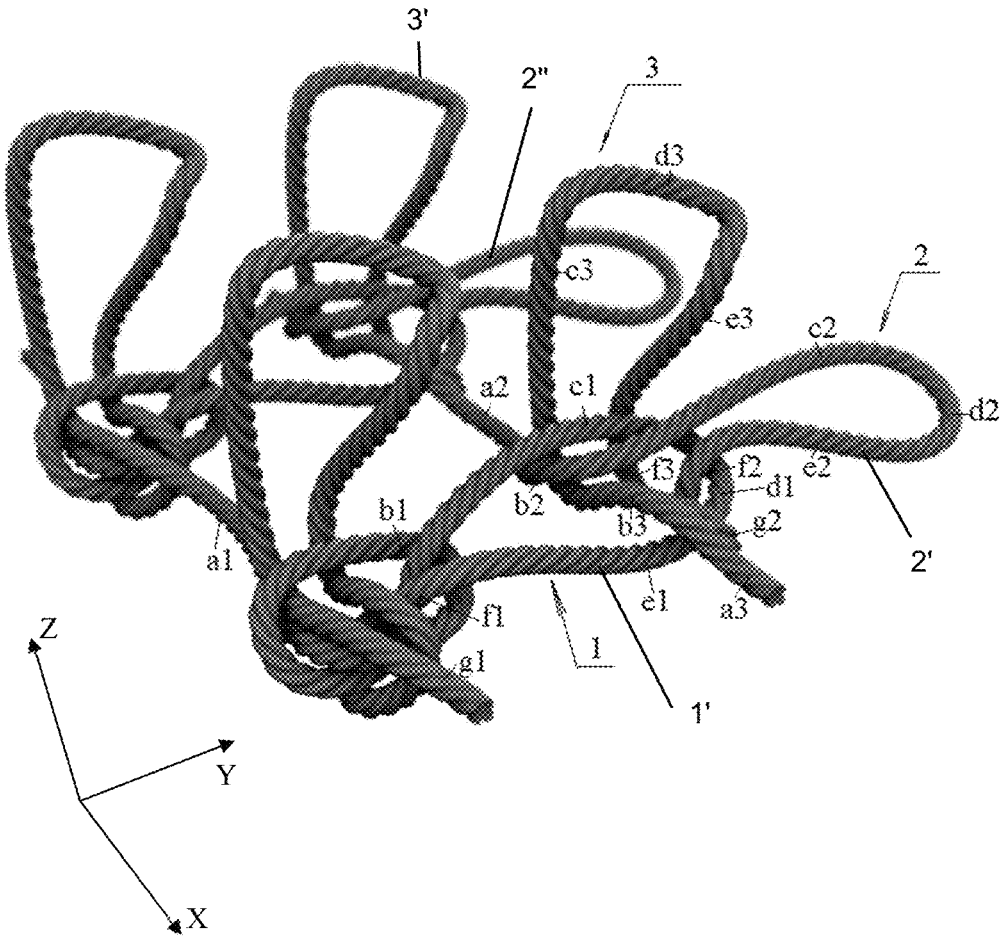
FIG. 3 shows a perspective view of a computer generated image of a layout of formation of loops in one layer.

The resulting layer may have an appearance shown in FIG. 3.

Figure 4:
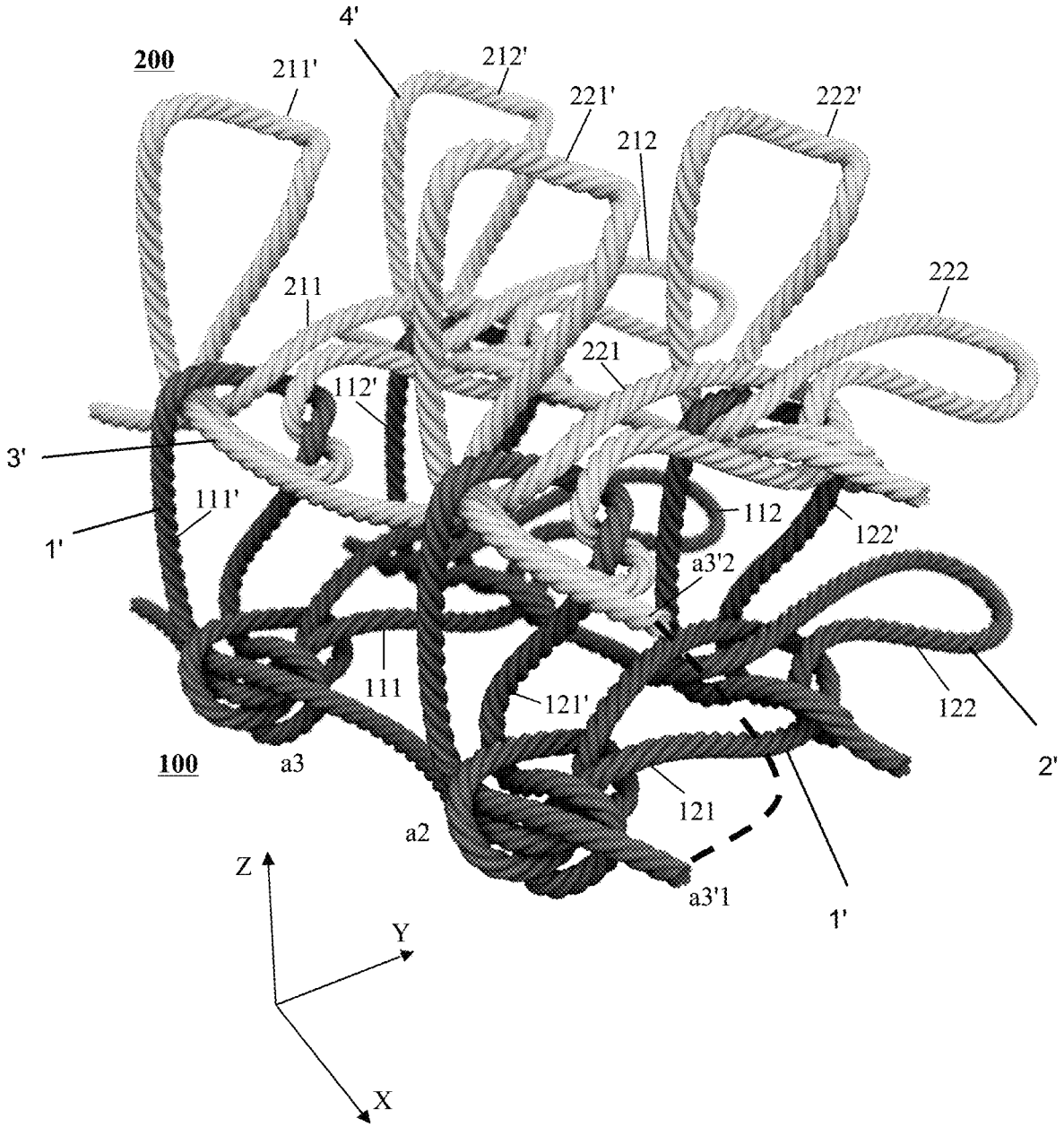
FIG. 4 shows a perspective view of a computer generated image of a layout of two connected layers of a three-dimensional knitted material.

FIG. 4 shows a principal layout for forming several layers (100, 200, etc.) of a three-dimensional knitted material.

The loops (111), (112) are formed in the first wale (if counted from left to right, upward) of the first horizontal layer (the Y, X coordinate plane); the loops (111') and (112') of the same first wale are formed in two vertical layers (the Z, X coordinate plane). The loop (111') is formed from the same loop and thread as the loop (111), and the loop (112') is formed from the same loop (111) as the loop (112). Similarly, the loop (121') for the second wale of the first layer is formed from the same loop as the loop (121) in the vertical layer; the loop (122) is formed from the loop (121) in a horizontal layer; the loop (122') is formed from the loop (121) in the vertical layer.

The loop (211) in the first wale for the second layer is formed in a horizontal direction, the loop (211') is formed from the same loop in a vertical direction. And the loop (212) is formed in a horizontal direction through the loops (211) and (112'), or connects them, and the loop (212') is formed from the same loops (211) and (112') in a vertical direction.

Similarly for the second wale of the second layer: the loop (222) is formed in a horizontal plane from the horizontal loops (221) and (122'); the loop (222') is also formed from the loops (221) and (122'), but in a vertical plane.

When passing from a layer to a layer, the thread of the last loop, e.g. threads (a3'1, a3'2) (see FIG. 4), if it belongs to the last loop in a layer (a corner loop) and a fabric is formed from one thread, the a3'1 thread will pass to the next layer and will become the a3'2 thread (the last loop of the first course in the second layer, as shown in the figure). FIG. 4 shows this passage as a dashed line.

When loops in one course are formed, the a3 thread passes into the a2 thread (see FIGS. 1, 2, 4).

Figure 5:
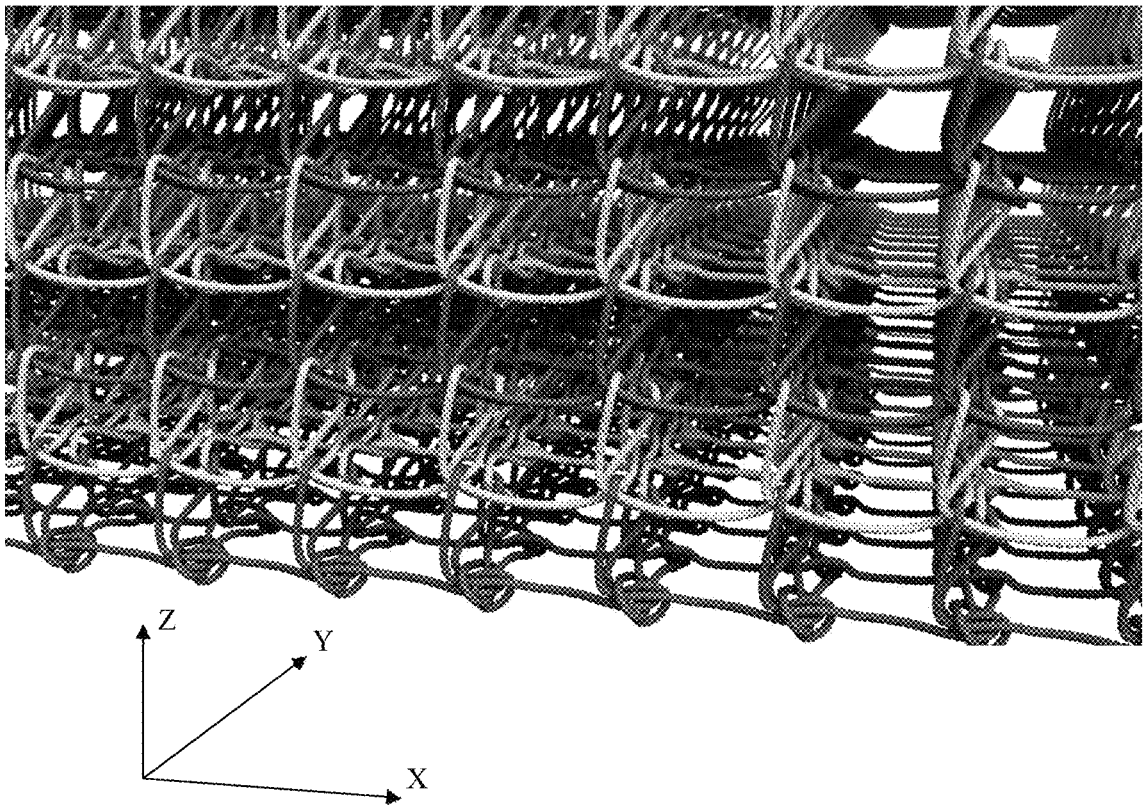
FIG. 5 shows a perspective view of a computer generated image of a general view of a three-dimensional knitted material.
Figure 6:
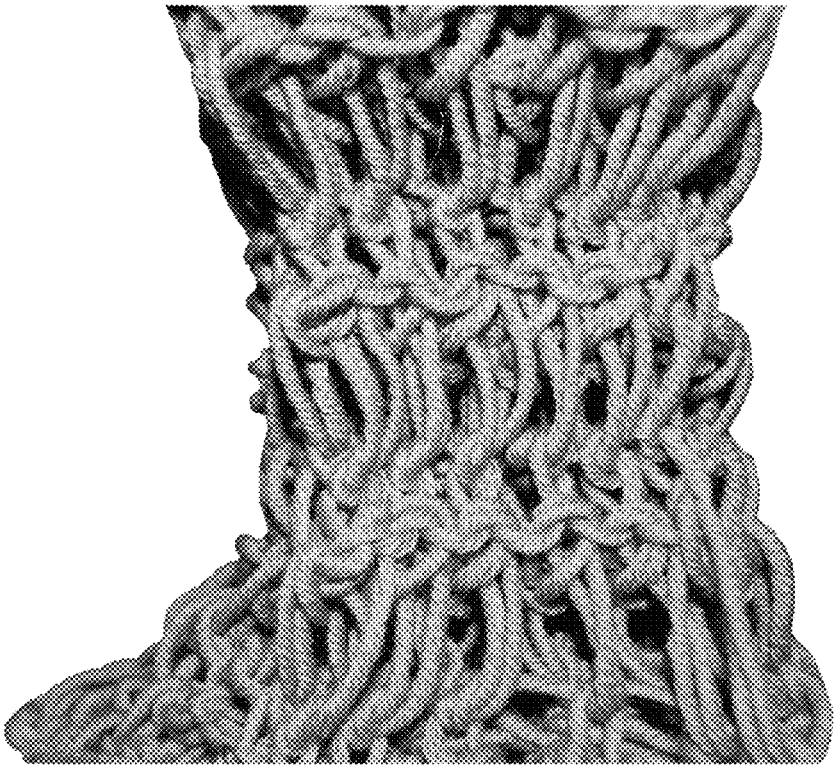
FIG. 6 shows a photo of a three-dimensional knitted material: an example of a finished product having 6 loops in a course and 6 loops in a wale.
Figure 7:
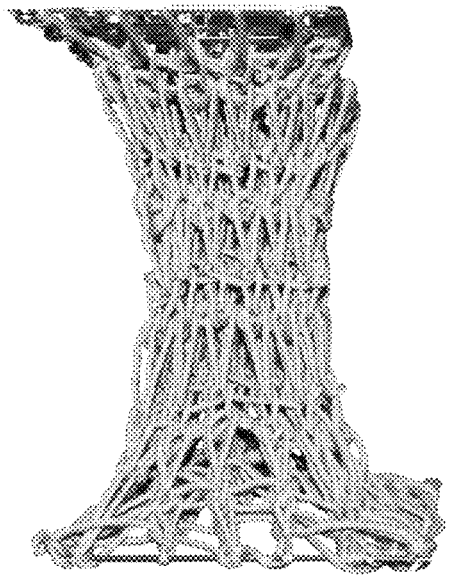
FIG. 7 shows a photo of a structure of the three-dimensional knitted material of FIG. 6, a front view.
Figure 8:
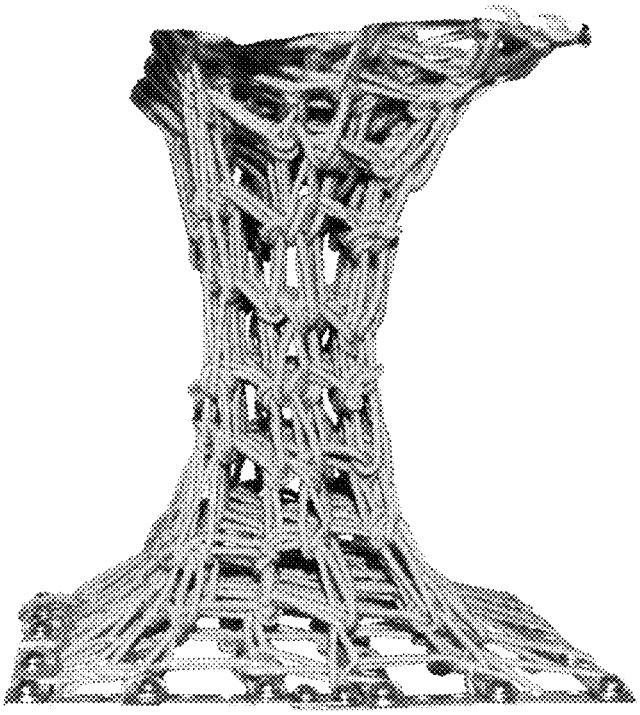
FIG. 8 shows a photo of a structure of the three-dimensional knitted material of FIG. 6, a side view.
Figure 9:
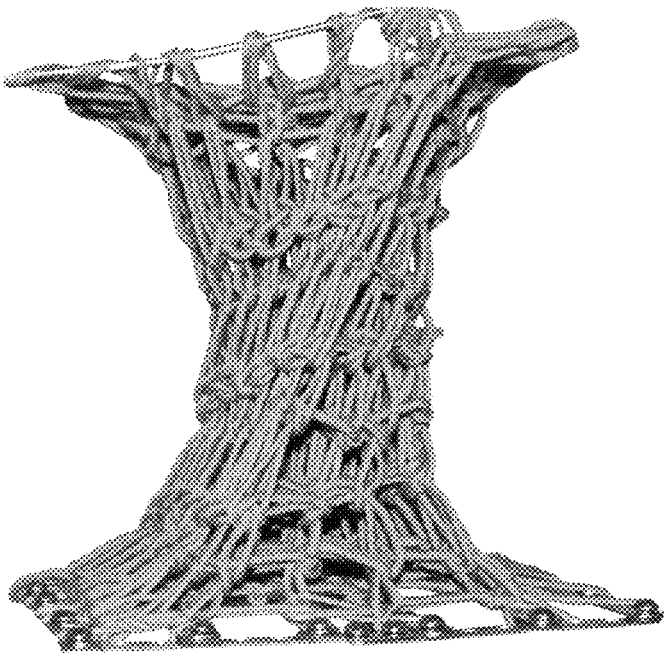
FIG. 9 shows a photo of a structure of the three-dimensional knitted material of FIG. 6, a view of a twist.

Subsequent wales and layers of a three-dimensional knitted material may be formed similarly. The produced connection of the knitted layers may have an appearance and structure shown in FIG. 5.

An example of the appearance of the proposed knitted material—finished product—is shown in FIGS. 6-9.

The proposed knitted material is not limited by a certain number of loops in a course both in a horizontal plane and in a vertical plane. Engineering (linear) dimensions of the production equipment may be the only limitation.

When creating products, various weaves, including patterned ones, may be used. Threads for conventional processes of the knitting art may be used for manufacturing knitted material. It is possible to use several threads, similarly to conventional knitted material, e.g. multicolored, or, e.g. synthetic and natural.

Due to an additional volume, the proposed knitted material may be used as the base for producing various three-dimensional figures, such as balls, cubes, hoops, hemispheres, including hollow ones, etc.

The proposed three-dimensional knitted material may be used in various technical fields. It is supposed that the most promising is the use of the three-dimensional knitted material as a filtering material suitable for manufacturing filters, reinforcing materials for producing geogrids, prefabricated building structures.

The three-dimensional knitted material may replace up to 50% of the existing filters at a comparable cost. Most three-dimensional filters are manufactured from flat nonwoven fabrics to which a three-dimensional shape is imparted, in particular a corrugated shape. When using the three-dimensional knitted material with an adjustable structure, there is no need in additional shaping.

If a cheap synthetic material (e.g. a fishing line) is used, a three-dimensional geogrid applicable in the field of construction and landscape design may be manufactured. In particular, it is possible to grow plants in geogrids and attach them to walls. Such a structure will maintain its shape due to strength and rigidity and its appearance due to the regular structure. The same properties can improve reinforcement of lightweight building panels, and the principle of forming the fabric structure enables to produce panels of complex shapes.

I claim:

1. A knitted material, comprising: a plurality of knitted layers connected to each other so as to form a three-dimensional product, wherein a first knitted layer of said plurality of knitted layers is comprised of a first thread and a second thread, wherein said first thread is comprised of a first planar loop being coplanar with said first knitted layer, a first nonplanar loop being in a different plane from said first knitted layer in a z-direction and being continuous with said first planar loop, a first next planar loop being coplanar with said first knitted layer, and a first next nonplanar loop being in said different plane and being continuous with said first next planar loop, wherein said second thread is comprised of a second planar loop being coplanar with said first knitted layer, a second nonplanar loop being in said different plane and being continuous with said second planar loop, a second next planar loop being coplanar with said first knitted layer, and a second next nonplanar loop being in said different plane and being continuous with said second next planar loop, wherein said second planar loop and said second nonplanar loop are run through said first planar loop, said first planar loop and said second planar loop forming a first wale in a y-direction of said first knitted layer, said first planar loop and said first next planar loop being coplanar in an x-direction of said first knitted layer, wherein a second knitted layer of said plurality of knitted layers is in a parallel plane to x-direction and y-direction of said first knitted layer of said plurality of layers, said second knitted layer being comprised of a third thread, and wherein said second knitted layer is attached to said first nonplanar loop, said first next nonplanar loop, said second nonplanar loop and said second next nonplanar loop being in said different plane so as to form a three-dimensional knitted material.

2. The knitted material, according to claim 1, wherein said first nonplanar loop is perpendicular to said first planar loop.

3. The knitted material, according to claim 1, wherein said third thread is comprised of a third planar loop being coplanar with said second knitted layer, a third nonplanar loop being in said different plane and being continuous with said third planar loop, a third next planar loop being coplanar with said second knitted layer, and a third next nonplanar loop being in said different plane and being continuous with said third next planar loop, wherein said first nonplanar loop runs around said third planar loop.

4. The knitted material, according to claim 1, wherein said first thread and said second thread are connected so as to be a continuous thread.

5. The knitted material, according to claim 1, wherein said first thread and said second thread are separate threads.

* * * * *